US007004299B2

(12) United States Patent
Eich et al.

(10) Patent No.: US 7,004,299 B2
(45) Date of Patent: Feb. 28, 2006

(54) PROCESS FOR IDENTIFYING AN EMBOSSED IMAGE OF A COIN IN AN AUTOMATIC COIN MACHINE

(75) Inventors: Manfred Eich, Hamburg (DE); Markus Adameck, Lippstadt (DE); Michael Hossfeld, Hamburg (DE)

(73) Assignee: National Rejectors, Inc. GmbH, (DE)

( * ) Notice: Subject to any disclaimer, the term of this patent is extended or adjusted under 35 U.S.C. 154(b) by 187 days.

(21) Appl. No.: 10/754,884

(22) Filed: Jan. 10, 2004

(65) Prior Publication Data

US 2004/0168881 A1 Sep. 2, 2004

(30) Foreign Application Priority Data

Jan. 10, 2003 (DE) ..... 103 00 608

(51) Int. Cl.
*G07D 5/00* (2006.01)

(52) U.S. Cl. ..... 194/328

(58) Field of Classification Search ..... 194/328, 194/302, 330; 382/136; 73/163; 250/200, 250/200.1, 216, 226; 209/576, 577, 578, 209/581, 582

See application file for complete search history.

(56) References Cited

U.S. PATENT DOCUMENTS

| | | | | |
|---|---|---|---|---|
| 5,483,602 | A * | 1/1996 | Stenzel et al. | 382/135 |
| 6,499,581 | B1 * | 12/2002 | Yoshida et al. | 194/318 |
| 6,685,000 | B1 * | 2/2004 | Sugata et al. | 194/328 |
| 2002/0186878 | A1 * | 12/2002 | Hoon et al. | 382/149 |

* cited by examiner

*Primary Examiner*—Donald P. Walsh
*Assistant Examiner*—Mark J. Beauchaine

(57) ABSTRACT

To identify an embossed image of a coin in an automatic coin machine, the coin requiring identification is moved past an image receiver and a light source, the light source having at least two lighting portions which illuminate an object field of the coin requiring identification from different directions under the same angle with respect to the surface normal of the object field and with wavelength ranges which do not overlap each other. An image receiver records one picked-up exposure of the object field from which images are obtained for each of the individual lighting portions of the individual wavelength ranges. A maximum image is then determined from the images, wherein each pixel has associated therewith the maximal intensity value from the images of the individual wavelength ranges. A genuine-coin or counterfeit-coin signal is determined from the maximum image.

22 Claims, 4 Drawing Sheets

PROCESS FOR IDENTIFYING AN EMBOSSED IMAGE OF A COIN IN AN AUTOMATIC COIN MACHINE

TECHNICAL FIELD OF THE INVENTION

The present invention is directed, in general, to a process for identifying an embossed image of a coin in an automatic coin machine.

BACKGROUND OF THE INVENTION

Automatic coin machines such as coin testers discriminate a predetermined set of coins within a very short time. In this respect, a number of processes are known, a multiplicity of which employ the coin material as a discrimination criteria. The thickness and diameter of the coin are also resorted to for discrimination. However, the worldwide currency system cannot rule out that equal or nearly equal blanks are employed for different coins. Therefore, the embossed image is an important discrimination criterion for differentiating coins.

A process and device for processing an embossed card is known from DE 37 39 239 C2. The embossed side of the card is alternately illuminated from two opposed, oblique directions. An image of the card is picked up at these different illuminations. The difference of the picked-up images is compared to reference data to identify the embossed characters. However, this process is unsuitable for intensely reflective metallic surfaces of coins.

DE 33 05 509 describes an optical coin testing device in which a surface illuminated under one angle is viewed under different angles. The quotient obtained from the brightness under different angles provides information about the degree of gloss of the coin being tested.

U.S. Pat. No. 5,839,563 describes a coin tester in which a comparison of samples is made for the picked-up image of the coin. The coin is illuminated circularly to achieve an intense illumination of the object field.

DE 100 51 009 describes a method for identifying an embossed image of a coin in which the coin is moved past the light source and is illuminated from a different direction each across two or more lighting portions. A differential image determined from these exposures indicates whether the image is a photographic reproduction of the embossed image or is an embossed image.

It is the object of the present invention to provide a process for identifying an embossed image of a coin, which is apt to reliably identify a genuine-coin or counterfeit-coin signal for the inserted coin by simple means in an automatic coin machine.

SUMMARY OF THE INVENTION

To address the above-discussed deficiencies of the prior art, it is a primary object of the present invention to provide, for use in an automatic coin machine, identification of an embossed image of a coin in an automatic coin machine. The coin requiring identification is moved past an image receiver and a light source, the light source having at least two lighting portions which illuminate an object field of the coin requiring identification from different directions under the same angle with respect to the surface normal of the object field and with wavelength ranges which do not overlap each other. An image receiver records one picked-up exposure of the object field from which images are obtained for each of the individual lighting portions of the individual wavelength ranges. A maximum image is then determined from the images, wherein each pixel has associated therewith the maximal intensity value from the images of the individual wavelength ranges. A genuine-coin or counterfeit-coin signal is determined from the maximum image.

In the inventive process, the coin requiring identification is moved past an image receiver and a light source. The light source has at least two, preferably three, lighting portions which illuminate an object field of the coin requiring identification from different directions under the same angle with respect to the surface normal of the object field, with wavelength ranges which do not overlap each other. The object field of the coin preferably is the entire embossed image of the coin. The illumination of the embossed image is performed under the same angle for the illuminated portions. Such illumination is referred to herein as "Selective Stereo Gradient Method" (SSGM), because when the exposure is centrally recorded light is only received under a certain angle of reflection or gradient in the embossed image. An image receiver records one picked-up exposure of the surface illuminated as described above. From the one exposure, images are obtained for the individual lighting portions. For the purposes of the inventive process, the color fractions of the different wavelength ranges are separated. A maximum image is determined from the images thus obtained, in which each pixel has associated therewith the maximum intensity value each from the images. The genuine-coin or counterfeit-coin signal of the embossed image picked up is determined from this maximum image. In the inventive process, a maximum image is determined from one image, by separating the one image into partial images that are picked up from different directions, but at the same angle of inclination (azimuthal angle), which reproduces the coin surface sufficiently well for an identification of the embossed image.

For the generation of the genuine-coin or counterfeit-coin signal, determination of the center and diameter of the coin is useful for the exposure and/or maximum image. Preferably one or more circular ring segments having predetermined radii in the maximum image are cut out.

Surprisingly, the mean grey-scale value and/or its deviation, preferably its standard deviation, has been found to be a good indicator of the type of the coin requiring identification, for the circular ring segments. The benefit of this feature of the embossed image is that the mean grey-scale value and/or its deviation can be determined at comparatively low computation expenditure.

In another preferred step, the values of the pixels in the maximum image are transformed along circular ring profiles having a predetermined radius into a frequency representation. A Fourier transform, which preferably is configured as a fast Fourier transform (FFT), has proved to be useful as such a transformation. The transformed spectra are compared to reference spectra, with the deviation being taken into account in determining the genuine-coin or counterfeit-coin signals. Also, during this process step, simple comparison of spectra along circular ring profiles has been surprisingly found to be sufficient to obtain a reliable indication of the genuine or counterfeit nature of the embossed pattern.

In a further preferred aspect, differential images are determined from couples or sets of images for the individual lighting portions. The differential images allow a discrimination between photographic reproductions of the embossed image, on one hand, and are particularly suited for making a comparison for coincidence, a so-called template matching, between individual sections from the differential images and reference patterns. During this procedure, sections from exposures of an embossed image are compared to reference patterns.

In the inventive process, a counterfeit-coin signal is generated when the mean grey-scale value of a differential image is below a predetermined threshold value.

The separation of the images from the exposure is achieved by using filters that are transmissive to the individual wavelength ranges. Preferably, mosaic filters are employed when a complementary metal oxide semiconductor (CMOS) or charge-coupled device (CCD) camera is used.

In the inventive process, a classification is initially made for possible coin types in a first step, wherein those of the possible coin types are initially excluded for which the mean grey-scale value and/or the deviation, based on the maximum image, are outside of a predetermined interval; the transformed spectra are compared to the characteristic frequencies of the reference spectra, for the remaining coin types.

In a further aspect, one or more differential images are determined after the comparison of the spectra, then compared by sections to reference patterns of the coin types yet to be compared.

It is preferred that a genuine-coin signal for the coin to be tested is generated whenever the number of the possible coin types was reduced to a single coin type. It is also preferred that the counterfeit-coin signal be generated whenever no coin type is possible any longer, with all defined coin types having been differentiated from the picked up image.

The foregoing has outlined rather broadly the features and technical advantages of the present invention so that those skilled in the art may better understand the detailed description of the invention that follows. Additional features and advantages of the invention will be described hereinafter that form the subject of the claims of the invention. Those skilled in the art will appreciate that they may readily use the conception and the specific embodiment disclosed as a basis for modifying or designing other structures for carrying out the same purposes of the present invention. Those skilled in the art will also realize that such equivalent constructions do not depart from the spirit and scope of the invention in its broadest form.

Before undertaking the detailed description below, it may be advantageous to set forth definitions of certain words or phrases used throughout this patent document: the terms "include" and "comprise," as well as derivatives thereof, mean inclusion without limitation; the term "or" is inclusive, meaning and/or; the phrases "associated with" and "associated therewith," as well as derivatives thereof, may mean to include, be included within, interconnect with, contain, be contained within, connect to or with, couple to or with, be communicable with, cooperate with, interleave, juxtapose, be proximate to, be bound to or with, have, have a property of, or the like; and the term "controller" means any device, system or part thereof that controls at least one operation, whether such a device is implemented in hardware, firmware, software or some combination of at least two of the same. It should be noted that the functionality associated with any particular controller might be centralized or distributed, whether locally or remotely. Definitions for certain words and phrases are provided throughout this patent document, and those of ordinary skill in the art will understand that such definitions apply in many, if not most, instances to prior as well as future uses of such defined words and phrases.

BRIEF DESCRIPTION OF THE DRAWINGS

For a more complete understanding of the present invention, and the advantages thereof, reference is now made to the following descriptions taken in conjunction with the accompanying drawings, wherein like numbers designate like objects, and in which.

DETAILED DESCRIPTION OF THE INVENTION

FIGS. 1 through 4, discussed below, and the various embodiments used to describe the principles of the present invention in this patent document are by way of illustration only and should not be construed in any way to limit the scope of the invention. Those skilled in the art will understand that the principles of the present invention may be implemented in any suitably arranged device.

In the 3-color Selective Stereo Gradient Method (SSGM), three specific partial images of the coin constitute the basis of an evaluation of the topography of the embossed images. The partial images are extracted from a single exposure. To, this end, a light-emitting diode (LED) colored illumination ring having five LED's each in the red, blue, and green colors is disposed with the colors separated in three 120-degree sectors. When the coin passes through a light barrier a trigger signal is released which both launches an LED flash for all of the three colors at the same time and also causes the camera to pick up a single image. The CMOS or CCD camera employed for exposure is equipped with a mosaic filter, such as a Bayer patter, which separates the information from the three sectors in the exposure. After separation, there are three partial images again which illuminate the embossed pattern, which is to be recognized, from different directions.

Figure 1:
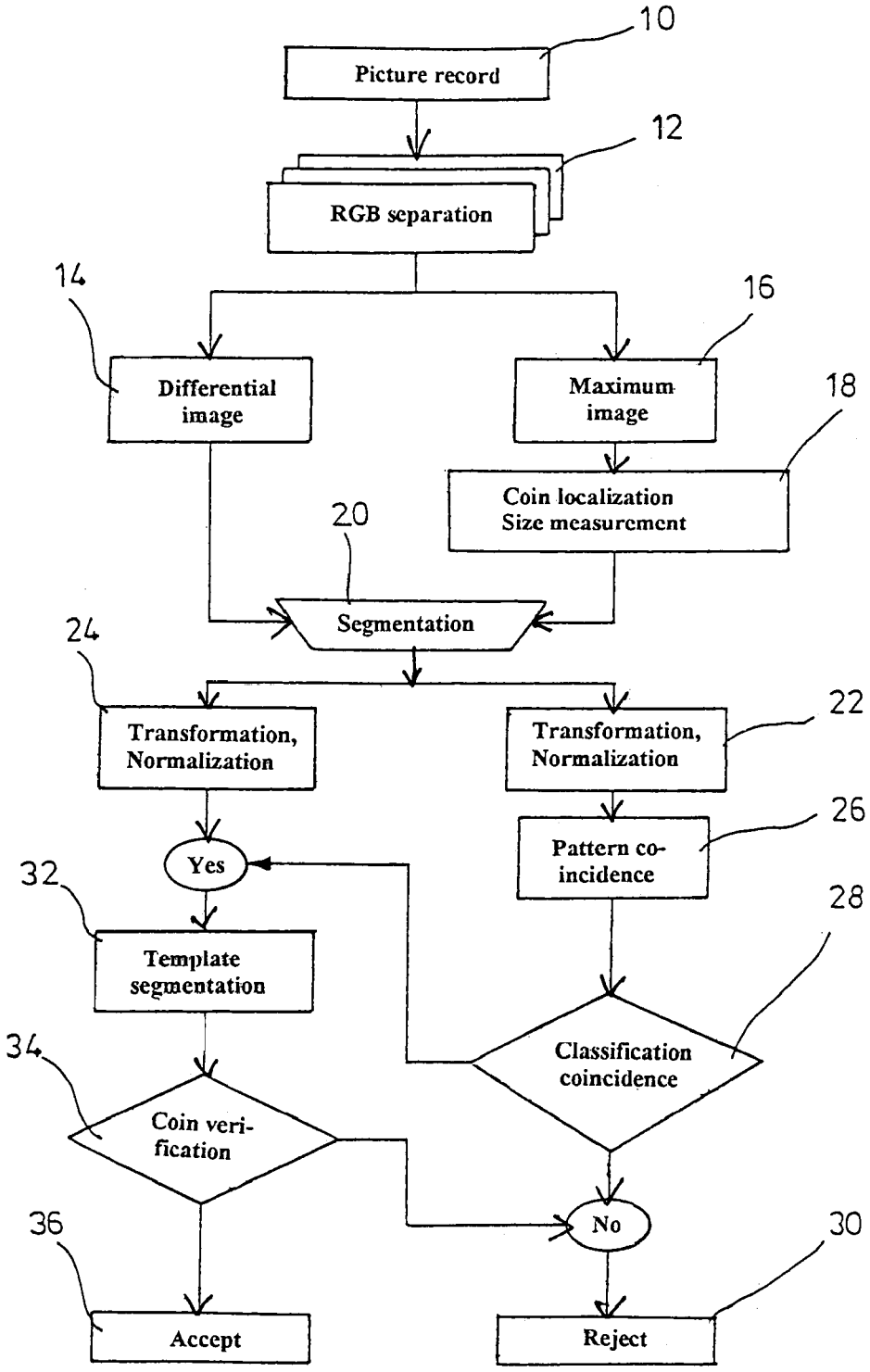
FIG. 1 is a high level flowchart for a process of identifying an embossed image on a coin within an automatic coin tester according to one embodiment of the present invention.

FIG. 1 is a high level flowchart for a process of identifying an embossed image on a coin within an automatic coin tester according to one embodiment of the present invention. In the flow scheme of FIG. 1, the exposed picture is recorded (step 10) and is separated into three individual images in process (step 12). For this purpose, the red, green, and blue colors are utilized.

A differential image is computed (step 14) from the partial images which, when used, ensures safety from counterfeit with respect to photos. The differential image is only employed to verify the embossed pattern in the inventive process, while a classification is made subsequently on determination of the maximum image (step 16), which is of a markedly more intense structure. The maximum image M is defined as $$M(x, y)=\max [R(x, y); G(x, y); B(x, y)],$$

where the value having the largest intensity is chosen for each point (x, y) from the set of the images R (x, y), G (x, y), and B (x, y).

Next the coin is located within the originally picked-up image (step 18), is cut out, and is converted to an image format with a predefined image size such as 256×256 pixels. The diameter of the coin is also determined during this operation, and the images are scaled to the same size independently of the coin size, which is important for the comparison of the mean grey-scale values discussed in further detail below.

A segmentation of the image is made (step 20) during which circular ring regions are regarded, starting from the image center. As it turns out, dissection of the image into an outer ring, a middle ring, and a coin center is particularly advantageous for 2-Euro coins.

The mean grey-scale value for the three ring regions and the standard deviation of the grey-scale values in the three ring regions are then determined (step 24).

Additionally, another discrimination feature is compared in the outer ring of the coin. To do this, the outer ring is converted into a binary image by the use of appropriate threshold values. The binary images are projected onto two axes that are perpendicular to each other. A feature characteristic of the embossed pattern of the coin is the spacing between the center of gravity (COG) and the geometrical center of the image. The center of gravity (COG) is determined as the mean value of the pixels weighted at the spacing. Here, the image is the scaled image in which the outer ring is regarded. The COG is determined by axis projection. A grey-scale value or colored image can be used instead of a binary image.

Optionally either concurrent with or subsequent to the above-described determination of the mean grey-scale value for the three ring regions and the standard deviation of the grey-scale values in the three ring regions (step 24), grey-scale values are sampled (step 22) on circular rings around the center of the scaled images. The radii of the circular rings have been predetermined in the exemplary embodiment. The values of the pixels along the circular ring profiles are Fourier transformed (FFT), and the dominant frequency of each FFT spectrum is determined. The dominant frequencies determined for the five circular rings, in their entirety, constitute a further feature characteristic of the coin.

A pre-comparison is made (step 26) as to whether the measuring values so far obtained for the picked-up coins are within predetermined reliability intervals. This comparison leads to a classification (step 28). If the classification reveals that the pattern does not match with any one of the predetermined references, the classification procedure results in a rejection 30 the coin (step 30). If it turns out that several coins are concerned, a template match is made for these coin types (step 32).

Figure 3:
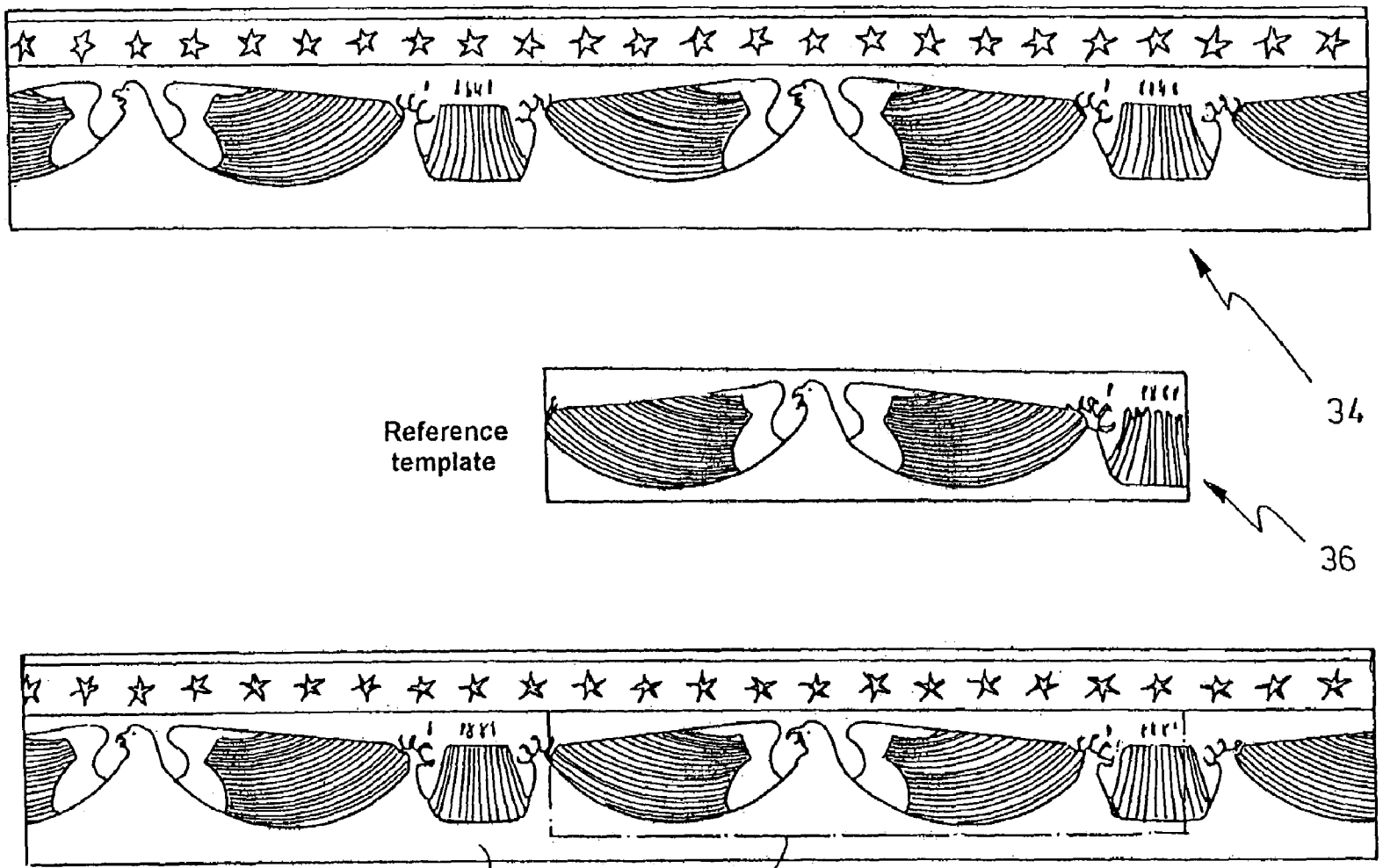
FIG. 3 illustrates a reference template successfully found in an unwrap image during identification of an embossed image on a coin within an automatic coin tester according to one embodiment of the present invention.

FIG. 3 illustrates a reference template successfully found in an unwrap image during identification of an embossed image on a coin within an automatic coin tester according to one embodiment of the present invention. As shown in FIG. 3, the image picked up for the coin is wound off for this purpose and is supplemented to have twice the angular range to avoid cuts in the reference sample. The image thus supplemented is compared to a reference pattern (step 34). As is shown in FIG. 3, the position is found for the reference pattern (step 36) in the image.

Verification of whether a coin type falls within a close range for selection is really taken into consideration (step 32). Here, the process may be modified such that any possible coin type is folded with the reference patterns of all coin types possible to determine the coin type exhibiting the maximum match.

In the concluding step, a check is made (step 34) for the differential image previously computed to determine whether the image is an embossed pattern or a photo of an embossed pattern. This may also be performed at the start of the comparison.

A multiplicity of different starts may be chosen for checking the differential image. In practice, two approaches have proved to be particularly advantageous. In a first approach, a section having the size of the template is cut out in the shape of the template pattern in that point of the image in which the pattern was found. This image section is converted into a binary image by using threshold values. For example, the sum of the mean grey-scale value plus the standard deviation of the mean grey-scale values in the pattern may be applied to fix the threshold value. Other variable or even fixed threshold values are imaginable.

Differential images are determined from the three partial images. It has proven particularly advantageous to determine a first differential image (Diff1) from the images for the red (R) and green (G) colors. A second differential image (Diff2) is determined from the images for the red (R) and blue (B) colors. In conclusion, a differential image (Diff12) is formed as a difference between the first and the second differential images. However, a maximum image can also be formed between the first differential image (Diff1) and the second differential image (Diff2): Diff12=max [Diff.1, Diff.2]. An image that is unfolded and is supplemented to have twice the angular range is prepared from the completed differential image (Diff12). This image in congruent with the image previously prepared for a comparison of patterns. At the same point, an image section having the size of the reference pattern is extracted from those unfolded images. The extracted image sections are multiplied by each other and the mean grey-scale value is computed for the product. If the mean grey-scale value is below a predetermined fixed threshold, the image is that of a photo. The reason is that if the image is a photo, insufficient information will be left behind in the grey-scale values of the product images after a multiplication of the original image by the differential images.

As an alternative to the above-described option, the reference template can also be converted into a binary image with an appropriate threshold value. For example, the sum of the mean grey-scale value in the pattern plus the standard deviation of the mean grey-scale values in the pattern may be used again as a threshold value. Other variable or fixed threshold values are also imaginable. As described above, the differential images are determined with the two image sections, the differential value and the binary reference image being multiplied by each other and the mean grey-scale value being computed for the product. Also here, an absence of a three-dimensional topology is recognized by the fact that the mean grey-scale value is below a predetermined threshold.

Other methods for combining the differential images with partial images are also possible. In the two variants discussed above, there is the common fundamental idea to combine partial images that produce differential images containing information in the form of grey-scale structures only when the coin requiring identification has an embossed pattern. If coin identification is to be corrupted by a photo, the differential images do not possess sufficient information. The key to detecting the information on the three-dimensional embossed image of the coin is in illumination of the coin. Illumination has to be homogeneous and be of the same intensity in the sectors.

After a successful identification of the embossed pattern, the identified coin is accepted (step 36).

Figure 2:
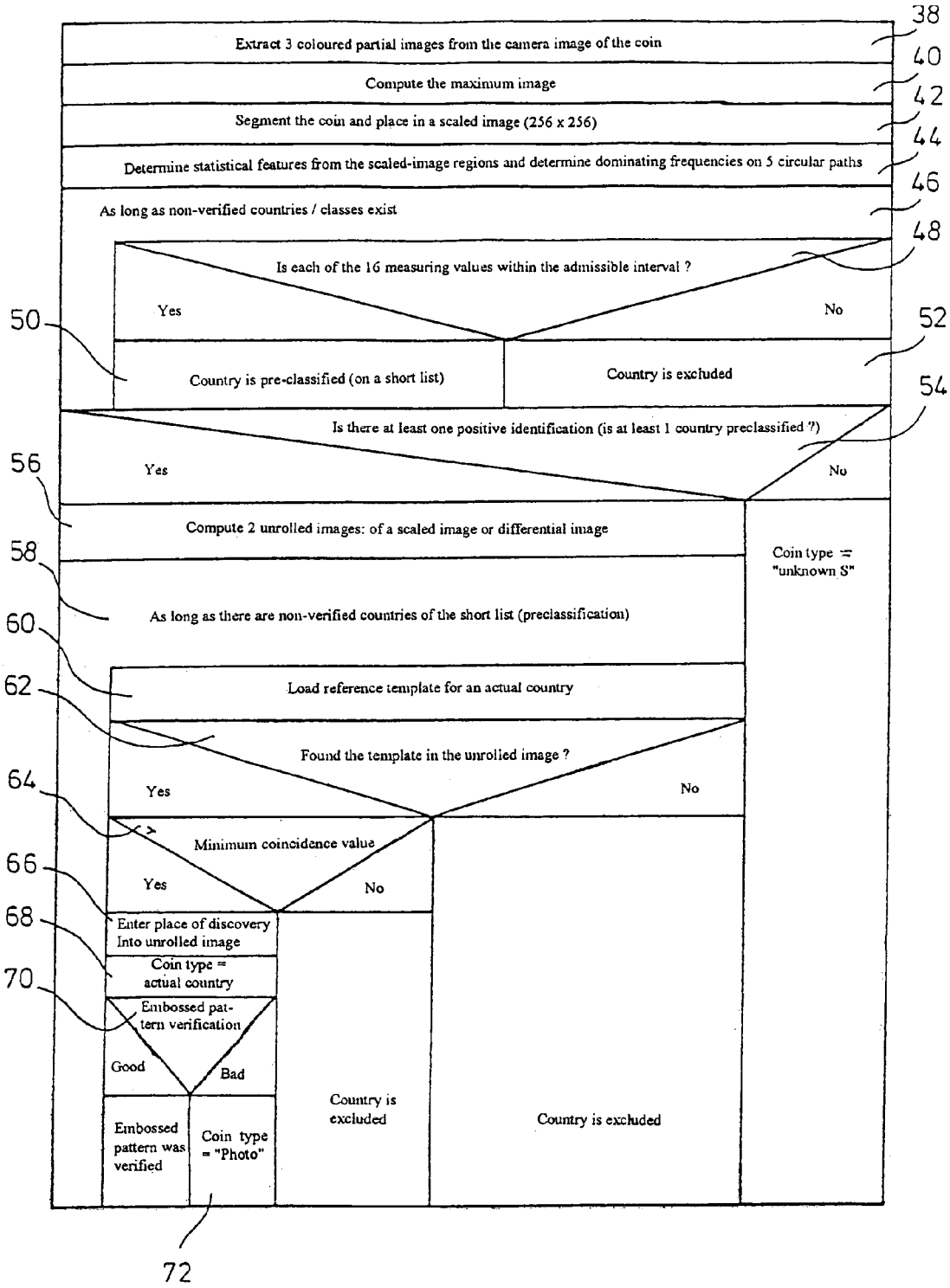
FIG. 2 is a Nassie-Schneidermann diagram for an exemplary application in which Euro coins from different countries are discriminated within an automatic coin tester according to one embodiment of the present invention.

FIG. 2 is a Nassie-Schneidermann diagram for an exemplary application in which Euro coins from different countries are discriminated within an automatic coin tester according to one embodiment of the present invention. FIG. 2 illustrates, in a structured diagram, the flow of the inventive process by the example of an identification of coins from different countries.

First, three coloured partial images (R, G, B images) are extracted (step 38) from the camera image picked up for the coin. Next, a maximum image is computed (step 40) from the three partial images, and the coin is segmented (step 42) from the picked-up image and the segmented image scaled to form a square format for further processing. Mean grey-scale values and dominant frequencies are compared to reference images (step 44) by performing the two steps described above. A loop is repeated (step 46) in the process as long as not all countries of the class requiring a test were completely verified. All told, the following characteristic features exist:

1. Mean grey-scale value in ring 1;
2. Standard deviation of grey-scale values in ring 1;
3. Mean grey-scale value in ring 2;
4. Relationship of mean grey-scale values in rings 1 and 2;
5. Standard deviation of grey-scale values in ring 2;
6. Mean grey-scale value in ring 3;
7. Relationship of mean grey-scale values in ring 2 and ring 3;
8. Standard deviation of grey-scale values in ring 3;
9. Relationship of mean grey-scale values of ring 1 and ring 3;
10. Spacing of the COG in ring 1 from the geometric centre of the coin and from the centre of the ring;
11. Diameter;
12. Dominant frequencies of grey-scale values on ring 1;
13. Dominant frequencies of grey-scale values on ring 2;
14. Dominant frequencies of grey-scale values on ring 3;
15. Dominant frequencies of grey-scale values on ring 4; and
16. Dominant frequencies of grey-scale values on ring 5.

A comparison is next m ad e (step 48) by means of the above-mentioned measuring values or a sub-set of these measuring values. When the comparison reveals that the measuring values are with in a predetermined reliability interval, the corresponding coin type will be set onto the short list (step 50); otherwise the coin type is excluded (step 54). It is merely for the frequency comparison that no uniform time interval is predetermined, but three possible measuring values are allowed for the frequency. Each of the three measuring values is tied to a predetermined reliability interval. A dominant frequency will be identified when the frequency measured is within one of the three predetermined reliability intervals.

A check is then made (step 54) as to whether at least one coin type will be on the short list. In this case, two unfolded images are computed (step 56) of which a first originates from the image as previously scaled in step 42 and the second one is the reference image.

As long as there are still non-tested coins, the following classification loop (step 58) is performed. For each iteration, the relevant reference template (reference pattern) is charged (step 60) for a coin type yet to be tested. The pattern is compared (step 62) to one of the unfolded images produced earlier. When the template is found in the unfolded image and the coincidence exceeds a minimum value (step 64), the location where the template was found is entered into the unfolded image (step 66). For the sections, the above-described comparison is made while producing the product image (step 68). Subsequently, the embossed pattern is verified (step 70). When the value for the embossed pattern verification is poor, the coin under testing will also be withdrawn (step 72). If more than one coin should remain upon completion of the loop, the coin having the best comparative values (e.g. from step 48) can be selected from these coins.

Figure 4:
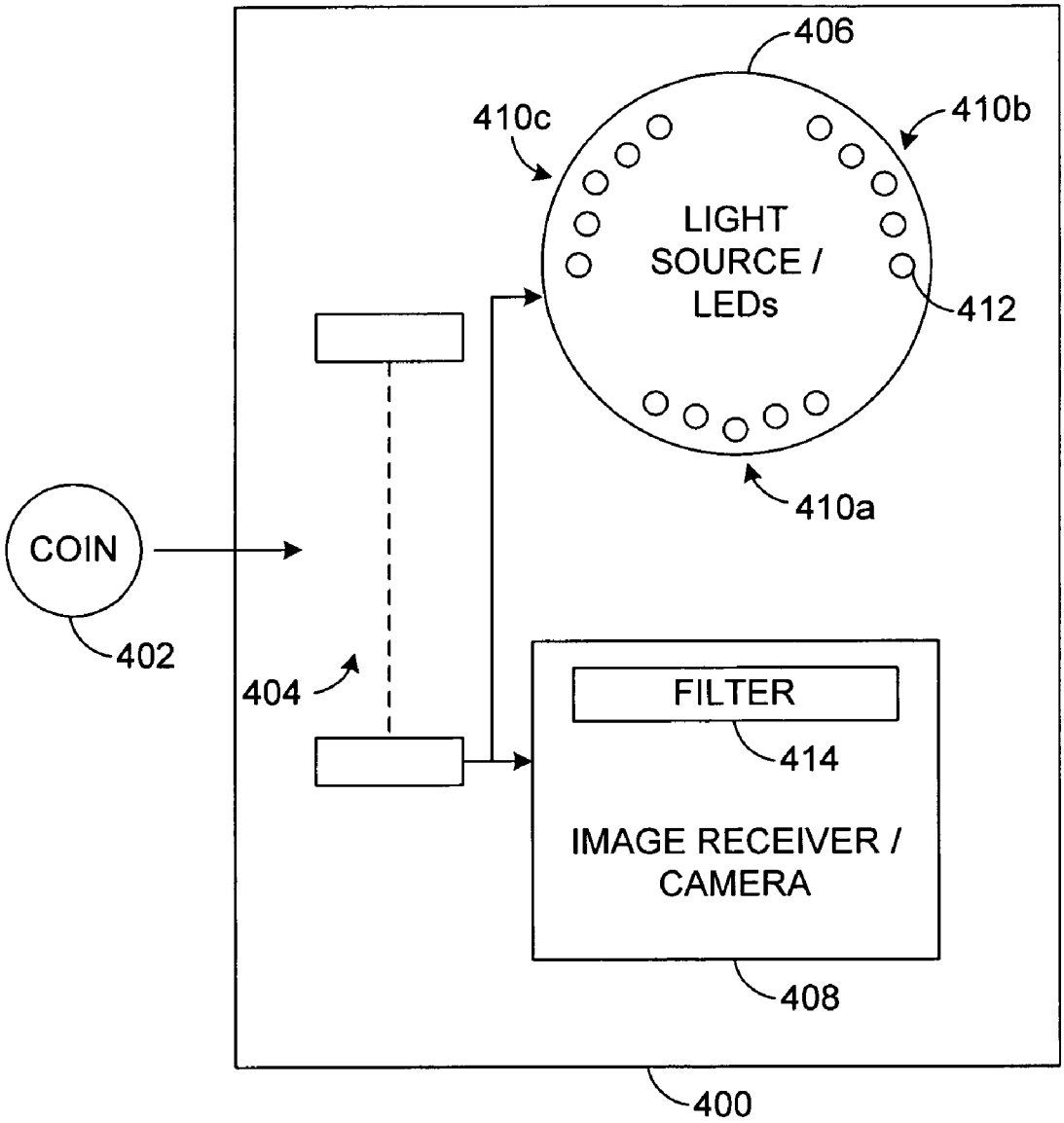
FIG. 4 illustrates an example coin machine capable of identifying an embossed image on a coin according to one embodiment of the present invention.

FIG. 4 illustrates an example coin machine 400 capable of identifying an embossed image on a coin 402 according to one embodiment of the present invention. As shown in FIG. 4, the coin machine 400 includes a light barrier 404, a light source 406, and an image receiver 408.

The light barrier 404 is capable of detecting a coin 402 entering the coin machine 400. When the coin 402 enters the coin machine 400, the coin 402 breaks or interrupts the light barrier 404. In response, the light barrier 404 sends a trigger signal to the light source 406 and the image receiver 408. This allows the light source 406 and the image receiver 408 to operate and attempt to identify an embossed image on the coin 402.

The light source 406 is capable of illuminating the coin 402. When the coin 402 passes through the light barrier 404, the light barrier 404 communicates a trigger signal to the light source 406. The light source 406 then illuminates an object field of the coin 402, allowing the image receiver 408 to capture an image of the coin 402. As shown in FIG. 4, the light source 406 has multiple lighting portions 410*a*–410*c*, each of which includes a number of light emitting diodes (LEDs) 412. In particular embodiments, the light source 406 has three lighting portions 410*a*–410*c* separated into three 120-degree sectors, where one portion has red LEDs 412, another portion has blue LEDs 412, and the third portion has green LEDs 412. The lighting portions 410*a*–410*c* illuminate an object field of the coin 402 from different directions under the same angle with respect to the surface normal of the object field. The lighting portions 410*a*–410*c* also have wavelength ranges that do not overlap each other. While this example shows three lighting portions 410*a*–410*c*, the light source 406 could have a different number of lighting portions, such as two.

The image receiver 408 captures an image of the coin 402 as illuminated by the light source 406. When the coin 402 passes through the light barrier 404, the light barrier 404 communicates a trigger signal to the light source 406 and the image receiver 408. The light source 406 then illuminates an object field of the coin 402, and the image receiver 408 captures a single image of the illuminated coin 402. The image receiver 408 could, for example, represent a CMOS or CCD camera. As shown in FIG. 4, the image receiver 408 may include a mosaic filter 414.

Once the image receiver 408 records an exposure of the object field of the coin 402, the coin machine 400 uses the captured image and obtains an image for each of the individual lighting portions 410*a*–410*c*. A maximum image is then determined from the images obtained, where each pixel in the maximum image is associated with the maximum intensity value each from the images. As described above, a genuine-coin or counterfeit-coin signal of the embossed image picked up is then determined from this maximum image.

It is important to note that while the present invention has been described in the context of a fully functional system, those skilled in the art will appreciate that at least portions of the mechanism of the present invention are capable of being distributed in the form of a machine usable medium containing instructions in a variety of forms, and that the present invention applies equally regardless of the particular type of signal bearing medium utilized to actually carry out the distribution. Examples of machine usable mediums include: nonvolatile, hard-coded type mediums such as read only memories (ROMs) or erasable, electrically programmable read only memories (EEPROMs), recordable type mediums such as floppy disks, hard disk drives and compact disc read only memories (CD-ROMs) or digital versatile discs (DVDs), and transmission type mediums such as digital and analog communication links.

Although the present invention has been described in detail, those skilled in the art will understand that various changes, substitutions, variations, enhancements, nuances, gradations, lesser forms, alterations, revisions, improvements and knock-offs of the invention disclosed herein may be made without departing from the spirit and scope of the invention in its broadest form.

What is claimed is:

1. A process for identifying an embossed image of a coin in an automatic coin machine, comprising:

moving a coin requiring identification past an image receiver and a light source, wherein the light source has at least two lighting portions that illuminate an object field of the coin requiring identification from different directions under the same angle with respect to a surface normal of an object field and with individual wavelength ranges that do not overlap;

recording, with the image receiver, one picked-up exposure of the object field from which images are gained for the individual lighting portions of the individual wavelength ranges;

determining a maximum image from the images, wherein each pixel within the maximum image has associated therewith a maximal intensity value from the images of the individual wavelength ranges; and generating a genuine-coin or counterfeit-coin signal based upon the maximum image.

2. The process according to claim 1, wherein a center and a diameter of the coin are determined for the picked-up exposure and/or the maximum image.

3. The process according to claim 1, wherein one or more circular ring segments having predetermined radii are cut out in the maximum image.

4. The process according to claim 3, wherein the genuine-coin or counterfeit-coin signal is generated using a mean grey-scale value of the circular ring segments and/or a deviation of the grey-scale value from the mean grey-scale value.

5. The process according to claim 1, wherein the values of the pixels in the maximum image are transformed into a frequency representation along circular ring profiles having a predetermined radius.

6. The process according to claim 5, wherein a fast Fourier transform (FFT) is carried out as a transformation of the pixel values.

7. The process according to claim 6, wherein spectra for the transformed pixel values are compared to reference spectra and deviations are taken into account in determining the genuine-coin or counterfeit-coin signals.

8. The process according to claim 1, wherein differential images are determined for the individual lighting portions from pairs of images.

9. The process according to claim 8, wherein one or more sections from the differential images are compared to reference patterns for coincidence thereof.

10. The process according to claim 1, wherein separation of the picked-up exposure into images of the individual lighting portions is performed via filters.

11. The process according to claim 10, wherein a mosaic filter for a CMOS or CCD camera is used for the separation of the exposure into images.

12. The process according to claim 1, wherein a counterfeit-coin signal is generated when a mean grey-scale value of a differential image is below a predetermined threshold value.

13. The process according to claim 1, wherein a classification is initially made for possible coin types in a first step, wherein those of the possible coin types for which (a) a mean grey-scale value and/or a deviation, based on the maximum image, are outside of a predetermined interval and/or (b) spectra of transformed pixel values with characteristic frequencies thereof deviate from predetermined reference spectra of the respective coin type are initially excluded.

14. The process according to claim 13, wherein one or more differential images are determined from exposures of the wavelength ranges for the coin types still remaining after the initial classification, and wherein the one or more differential images are compared by sections to reference patterns of any coin type yet to be compared.

15. The process according to claim 13, wherein a genuine-coin signal is generated whenever a number of non-excluded possible coin types is reduced to a single coin type.

16. The process according to claim 13, wherein a counterfeit-coin signal is generated whenever a number of non-excluded possible coin types is reduced to zero.

17. A coin machine, comprising:

a light barrier operable to detect a coin;

a light source comprising at least two lighting portions operable to illuminate an object field of the coin from different directions under a same angle with respect to a surface normal of the object field and with individual wavelength ranges that do not overlap; and an image receiver operable to record a picked-up exposure of the object field from which images are gained for the individual lighting portions of the individual wavelength ranges;

wherein the coin machine is operable to determine a maximum image from the images and generate a genuine-coin or counterfeit-coin signal based upon the maximum image, each pixel within the maximum image having associated therewith a maximal intensity value from the images of the individual wavelength ranges.

18. The apparatus of claim 17, wherein:

one or more circular ring segments having predetermined radii are cut out in the maximum image; and the genuine-coin or counterfeit-coin signal is generated using at least one of: a mean grey-scale value of the circular ring segments and a deviation of the grey-scale value from the mean grey-scale value.

19. The apparatus of claim 17, wherein:

the values of the pixels in the maximum image are transformed into a frequency representation along circular ring profiles having a predetermined radius;

a fast Fourier transform (FFT) is carried out as a transformation of the pixel values; and spectra for the transformed pixel values are compared to reference spectra and deviations are taken into account in determining the genuine-coin or counterfeit-coin signals.

20. The apparatus of claim 17, wherein:

differential images are determined for the individual lighting portions from pairs of images; and one or more sections from the differential images are compared to reference patterns for coincidence thereof.

21. The apparatus of claim 17, wherein:

the image receiver comprises a CMOS or CCD camera having a mosaic filter; and the mosaic filter is operable to separate the picked-up exposure into images of the individual lighting portions.

22. The apparatus of claim 17, wherein:

the coin machine makes an initial classification for possible coin types, wherein those of the possible coin types for which (a) at least one of a mean grey-scale value and a deviation, based on the maximum image, are outside of a predetermined interval and/or (b) spectra of transformed pixel values with characteristic frequencies thereof deviate from predetermined reference spectra of the respective coin type are initially excluded;

one or more differential images are determined from exposures of the wavelength ranges for the coin types still remaining after the initial classification, the one or more differential images compared by sections to reference patterns of any coin type yet to be compared;

a genuine-coin signal is generated whenever a number of non-excluded possible coin types is reduced to a single coin type; and a counterfeit-coin signal is generated whenever a number of non-excluded possible coin types is reduced to zero.

* * * * *